US009297190B2

(12) United States Patent
Lee

(10) Patent No.: US 9,297,190 B2
(45) Date of Patent: Mar. 29, 2016

(54) HINGE DEVICE FOR A FOLDING DOOR

(71) Applicant: Chen-Hsiang Lee, Kaohsiung (TW)

(72) Inventor: Chen-Hsiang Lee, Kaohsiung (TW)

( * ) Notice: Subject to any disclaimer, the term of this patent is extended or adjusted under 35 U.S.C. 154(b) by 212 days.

(21) Appl. No.: 14/124,755

(22) PCT Filed: Oct. 31, 2013

(86) PCT No.: PCT/CN2013/086350

§ 371 (c)(1),
(2) Date: Dec. 9, 2013

(87) PCT Pub. No.: WO2015/024297

PCT Pub. Date: Feb. 26, 2015

(65) Prior Publication Data

US 2015/0330127 A1 Nov. 19, 2015

(30) Foreign Application Priority Data

Aug. 20, 2013 (CN) ..... 2013 1 0364195

(51) Int. Cl.
*E05D 3/12* (2006.01)
*E05D 7/00* (2006.01)
(Continued)

(52) U.S. Cl.
CPC ..... *E05D 3/122* (2013.01); *E05D 5/0223* (2013.01); *E05D 7/009* (2013.01); *E05D 11/0054* (2013.01); *E05D 2011/0072* (2013.01); *Y10T 16/533* (2015.01)

(58) Field of Classification Search
CPC ... Y10T 16/541; Y10T 16/557; Y10T 16/533; E05D 1/04; E05D 3/122; E05D 15/26; E05D 15/264; E05D 7/009; E05D 5/0223; E05D 11/0054; E05D 2011/0072; E05Y 2900/132; E06B 3/48; E06B 3/481
USPC ..... 16/354, 386, 250; 49/381, 386; 160/206, 213, 229.1, 235
See application file for complete search history.

(56) References Cited

U.S. PATENT DOCUMENTS 3,092,870 A * 6/1963 Baer ..... E05D 1/00 16/277
3,402,422 A 9/1968 Baer ..... 16/163
4,679,277 A * 7/1987 Shibata ..... E05D 3/122 16/354

(Continued)

FOREIGN PATENT DOCUMENTS

CN 1576504 2/2005 ..... E05D 3/12
CN 10 2400624 4/2012 ..... E05D 3/12

(Continued)

*Primary Examiner* — William Miller
(74) *Attorney, Agent, or Firm* — Alan D. Kamrath; Kamrath IP Lawfirm, P.A.

(57) ABSTRACT

A hinge device (10) for connecting two door panels (12) of a folding door (14) includes two installation strips (26) and a connection strip (28) connecting the two installation strips (26). An installation slot (44) is formed in each installation strip (26) for receiving an inner end (24) of an associated door panel (12). Two toothed portions (50) are respectively formed on the installation strips (26) and mesh with each other. The connection strip (28) includes two shaft portions (62) respectively received in the toothed portions (50). The installation strips (26) are pivotable relative to the connection strip (28) between first and second positions. In the first position, the door panels (12) are unfolded, and the connection strip (28) is covered by the installation strips (26). In the second position, the door panels (12) are folded, and the toothed portions (50) are located inside of the connection strip (28).

18 Claims, 12 Drawing Sheets

(51) Int. Cl.
*E05D 5/02* (2006.01)
*E05D 11/00* (2006.01)

(56) References Cited

U.S. PATENT DOCUMENTS 4,976,008 A * 12/1990 Baer ..... E05D 3/122 16/273
4,996,739 A * 3/1991 Baer ..... E05D 1/04 16/354
4,999,878 A * 3/1991 Baer ..... E05D 1/04 16/354
5,062,181 A * 11/1991 Bobrowski ..... E05D 3/122 16/234
5,201,902 A * 4/1993 Baer ..... E05D 1/04 16/273
5,337,451 A * 8/1994 Goossens ..... E05D 3/122 16/354
5,435,372 A 7/1995 Kikuchi ..... 160/206
8,312,596 B2 * 11/2012 Self ..... A47K 3/36 16/250

FOREIGN PATENT DOCUMENTS

CN 10 2518371 6/2012 ..... E06B 3/48
CN 20 2544666 11/2012 ..... E06B 3/48
FR 2748770 11/1997 ..... E05D 1/04

* cited by examiner

HINGE DEVICE FOR A FOLDING DOOR

BACKGROUND OF THE INVENTION

The present invention relates to a hinge device and, more particularly, to a hinge device for a folding door.

A type of conventional folding door used, such as in an airplane lavatory, includes two door panels connected by a hinge. A hinge for a folding door of a lavatory used in Boeing commercial airliners includes two hinge members and a connection member. Each hinge member is coupled with an inner end of one of the door panels and includes a gear portion. Two ends of the connection member are pivotally coupled with the gear portions of the hinge members, respectively. The gear portions of the hinge members mesh with each other, allowing the door panels to be folded or unfolded for opening or closing purposes.

However, the conventional folding door has the following disadvantages in use:

(1) When the folding door is mounted at a site (e.g. a bathroom) and is in a closed state, the two hinge members face the inside of the bathroom, and the connection member faces the outside of the bathroom. Thus, the gear portions of the hinge members rust easily, because the gear portions are liable to be splashed by water inside the bathroom when the folding door is unfolded, reducing the smoothness of the pivotal movement of the door panels.

(2) After the folding door is mounted at the site (e.g. a bathroom), screws for fixing the hinge members to the door panels are exposed and, thus, adversely affect the aesthetical appearance and rust easily.

(3) When the folding door is in the closed state, the connection member is exposed outside the folding door and is, thus, vulnerable to destruction.

(4) A large gap exists between the door panels when the folding door is in the closed state, and the hinge members engage with each other by the gear portions only, failing to reliably secure the door panels together.

(5) Each hinge member has a column that deforms easily under impact from an external force applied improperly. This damages the meshing between the gear portions and adversely affects the smoothness of folding and unfolding operations of the door panels.

Thus, a need exists for a novel hinge device for effectively securing door panels of a folding door together in the closed state and enhancing the smoothness of folding and unfolding operations of the door panels.

BRIEF SUMMARY OF THE INVENTION

The present invention solves this need and other problems by providing a hinge device adapted for connecting inner ends of two door panels of a folding door to allow the door panels to pivot synchronously upon movement of one of the door panels. The hinge device includes two installation strips and a connection strip. Each installation strip extends in a longitudinal direction and includes first and second side walls spaced from each other in a thickness direction perpendicular to the longitudinal direction and a connection wall connected between the first and second side walls. Each of the first and second side walls includes inner and outer ends spaced in a width direction perpendicular to the longitudinal and thickness directions. The outer ends of the first and second side walls respectively protrude from the connection walls and away from the inner ends of the first and second side walls in the width direction. An installation slot is defined between the outer ends of the first and second side walls and adapted for receiving the inner end of an associated door panel. Each installation strip includes a toothed portion extending from the inner end of the second side wall thereof toward but spaced from the first side wall thereof. Each toothed portion includes a plurality of teeth formed on an outer face thereof, and the toothed portions of the installation strips mesh with each other, allowing the door panels to pivot synchronously upon movement of one of the door panels. The connection strip extends in the longitudinal direction and includes a cover portion and two shaft arms located in the cover portion and spaced from each other. Each shaft arm includes an outer end connected to the cover portion and an inner end forming a shaft portion. The shaft portion of each shaft arm is engaged in the toothed portion of one of the installation strips. The installation strips can be pivoted synchronously relative to the connection strip between a first position and a second position, with the shaft portions serving as pivots. When the installation strips are in the first position, the door panels are unfolded, and the connection strip is located in the installation strips. When the installation strips are in the second position, the door panels are folded, and the cover portion of the connection strip is partially located outside of the installation strips.

In examples, each installation strip further includes an extension extending from the inner end of the first side wall thereof toward but spaced from the second side wall thereof. The extension of each installation strip includes a distal end, and the toothed portion and the distal end of the extension are spaced from each other and define an opening therebetween. When the installation strips are in the first position, the extensions of the installation strips abut with each other, and the distal ends of the extensions are located at a middle of the cover portion of the connection strip. When the installation strips are in the second position, the cover portion of the connection strip is located between the distal ends of the extensions of the installation strips.

In examples, each installation strip further includes a shield extending from the inner end of the second side wall thereof toward but spaced from the connection wall thereof. A coupling slot is defined by the shield and an inner face of an associated toothed portion and is substantially semi-circular in cross section. Each shaft portion of the connection strip is engaged in the coupling slot of one of the installation strips.

In examples, each installation strip includes an upper section, a lower section, and an intermediate section between the upper and lower sections. The toothed portion of each installation strip includes a plurality of teeth formed on an outer face thereof. A number of the teeth of the toothed portion at the intermediate section of each installation strip are less than a number of the teeth of the toothed portion at each of the upper and lower sections.

The present invention will become clearer in light of the following detailed description of illustrative embodiments of this invention described in connection with the drawings.

DETAILED DESCRIPTION OF THE INVENTION

Figure 3:
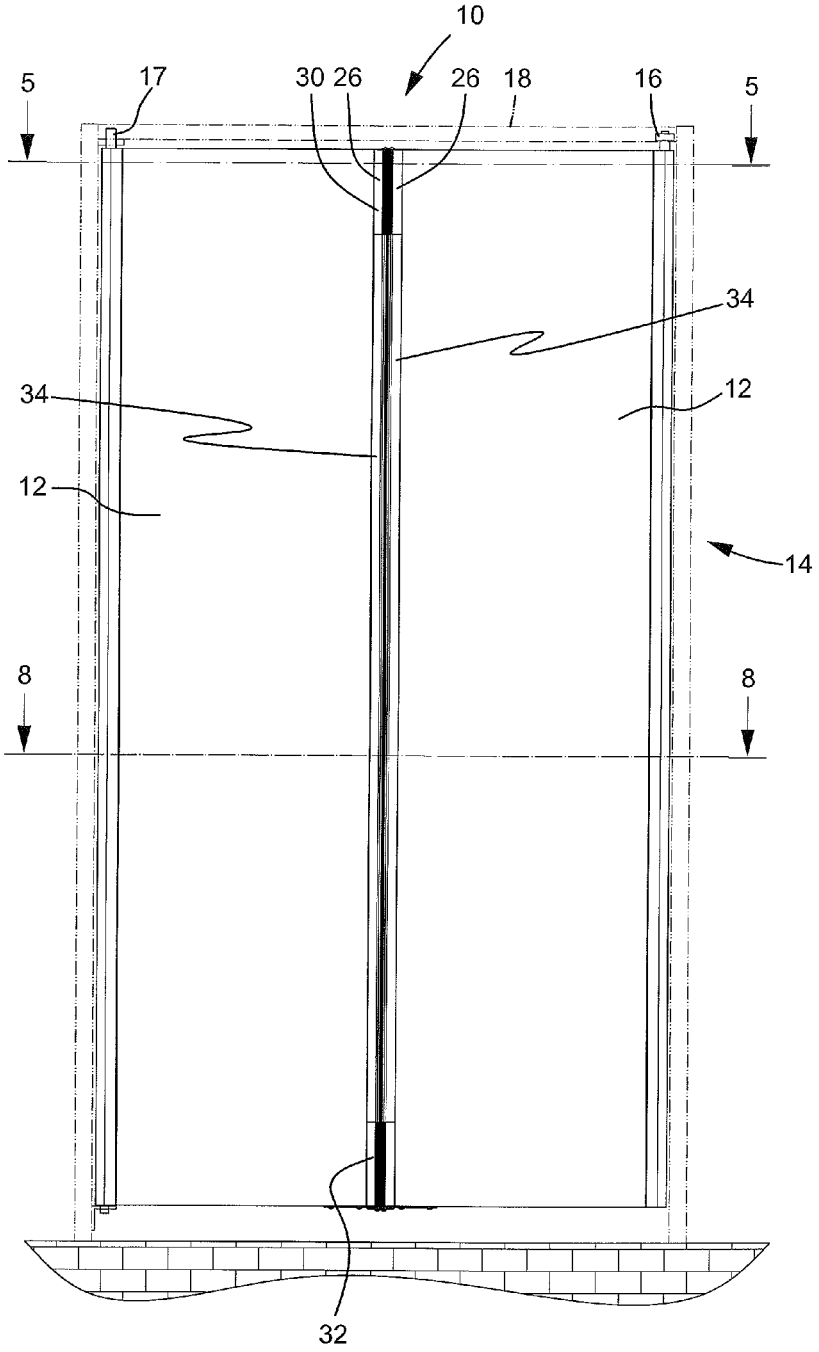
FIG. 3 is a schematic elevational view of the folding door of FIG. 1 mounted at a site.
Figure 4:
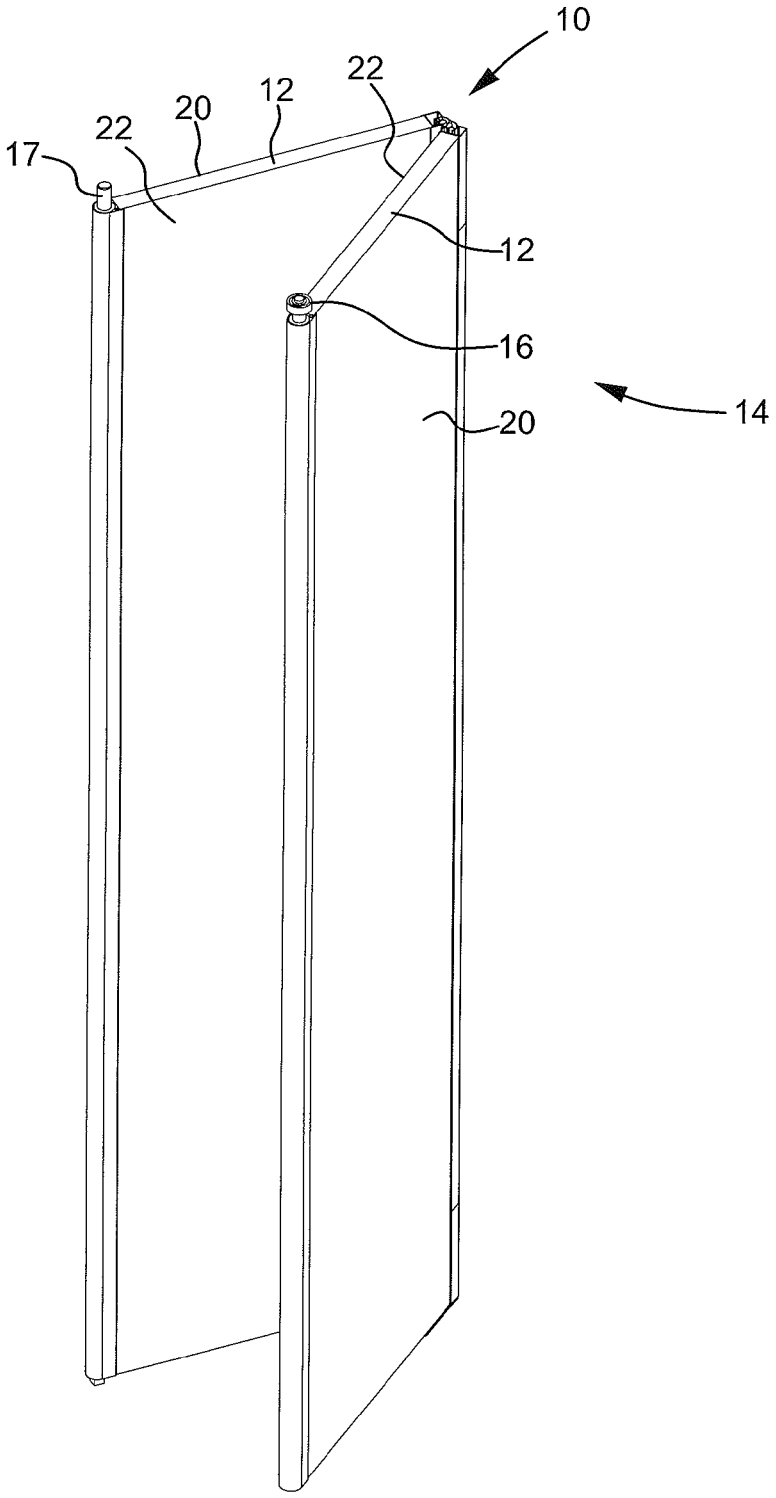
FIG. 4 is an assembled, perspective view of the folding door of FIG. 1.

A hinge device of a first embodiment according to the present invention is shown in FIGS. 1 through 9 of the drawings and generally designated 10. Hinge device 10 is adapted for connecting two door panels 12 to form a folding door 14. Folding door 14 can be mounted at a site, such as an airplane lavatory, a telephone box, a home bathroom, etc., for partitioning purposes. Referring to FIG. 3, a guide roller 16 is mounted on a top of one of door panels 12 of folding door 14, and a shaft 17 is disposed on an upper end of the other door panel 12 and is pivotally mounted to an upper frame strip 18 of an installation interface of the site. Guide roller 16 is slidably mounted in the upper frame strip 18 to allow door panels 12 to pivot relative to each other. Each door panel 12 includes an inner surface 20, an outer surface 22 opposite to inner surface 20, and an inner end 24. When folding door 14 is mounted at the site (e.g. a bathroom) and is in a closed state (see FIGS. 3 and 5), inner surfaces 20 of door panels 12 face an inside of the bathroom, and outer surfaces 22 of door panels 12 face an outside of the bathroom. Furthermore, inner ends 24 of door panels 12 face each other.

Hinge device 10 includes two installation strips 26 and a connection strip 28 connecting installation strips 26. Each installation strip 26 is in the form of a frame and includes an upper section 30, a lower section 32, and an intermediate section 34 between upper and lower sections 30 and 32. In this embodiment, upper section 30, lower section 32, and intermediate section 34 of each installation strip 26 are separate components. However, upper section 30, lower section 32, and intermediate section 34 of each installation strip 26 can be integrally formed as a one-piece component.

In this embodiment, each installation strip 26 extends in a longitudinal direction and includes a first side wall 36, a second side wall 37 spaced from first side wall 36 in a thickness direction perpendicular to the longitudinal direction, and a connection wall 38 connected between first and second side walls 36 and 37. Each of first and second side walls 36 and 37 includes inner and outer ends 40 and 42 spaced in a width direction perpendicular to the longitudinal and thickness directions. Outer ends 42 of first and second side walls 36 and 37 protrude from connection wall 38 and away from inner ends 40 in the width direction, such that an installation slot 44 is defined between outer ends 42 of first and second side walls 36 and 37 for receiving inner end 24 of an associated door panel 12. In this embodiment, each installation strip 26 is fixed on inner end 24 of the associated door panel 12 by screws 45 extending through holes 47 in connection wall 38 (see FIG. 5).

An extension 46 extends from inner end 40 of first side wall 36 of each installation strip 26 toward but spaced from second side wall 37 in the thickness direction and includes a distal end 48 having a lip. A toothed portion 50 extends from inner end 40 of second side wall 37 of each installation strip 26 toward but spaced from first side wall 36. Each toothed portion 50 is arcuate and includes a plurality of teeth 51 formed on an outer face thereof, and toothed portions 50 of installation strips 26 mesh with each other. In this embodiment, a shield 52 extends from inner end 40 of second side wall 37 of each installation strip 26 toward but spaced from connection wall 38. A coupling slot 54 is defined by each shield 52 and an inner face of an associated toothed portion 50 and is substantially semi-circular in cross section. Toothed portion 50 and distal end 48 of extension 46 of each installation strip 26 are spaced from each other in the thickness direction and define an opening 56 therebetween. Opening 56 is in communication with an interior space 58 of a corresponding installation strip 26. Preferably, each opening 56 has a size large enough for screws 45 and a hand tool (e.g. a screwdriver) to pass therethrough, allowing convenient operation of the hand tool to fix installation strips 26 to inner ends 24 of door panels 12 by screws 45.

Connection strip 28 extends in the longitudinal direction and includes two shaft arms 60 spaced from each other. A shaft portion 62 is formed on an inner end of each shaft arm 60 and has an outer diameter slightly smaller than an inner diameter of coupling slot 54 of an associated installation strip 26. A spacing between centers of shaft portions 62 of connection strip 28 is slightly smaller than a spacing between centers of toothed portions 50 of installation strips 26. Thus, when shaft portions 62 of connection strip 28 are respectively received in coupling slots 54 of installation strips 26, an outer surface of each shaft portion 62 will not be in contact with the entire inner face of an associated toothed portion 50, reducing the friction generated during pivotal movement of installation strips 26. Furthermore, a length of each shaft arm 60 of connection strip 28 is slightly smaller than a spacing between the center of toothed portion 50 and connection wall 38 of each installation strip 26. The length of each shaft arm 60 is determined according to the size of opening 56 of each installation strip 26.

The connection strip 28 further includes a substantially C-shaped cover portion 64 connected to outer ends of shaft arms 60. In this embodiment, a recessed portion 66 is formed in a middle of cover portion 64 and extends in the longitudinal direction. More specifically, cover portion 64 includes two arc-shaped sections 69 each having first and second ends. Each arc-shaped section 69 is connected to the outer end of a corresponding shaft arm 60 and has a center located in one of shaft portions 62 or one of coupling slots 54 (see FIG. 5). The first ends of arc-shaped sections 69 are connected with each other and meet at the middle of cover portion 64 to form recessed portion 66. Further, each end 67 of cover portion 64 (the second end of each arc-shaped section 69) protrudes beyond shaft arms 60, with shaft arms 60 located between ends 67 of cover portion 64. A length of each end 67 protruding beyond shaft arm 60 corresponds to a length of shield 52 of an associated installation strip 26, such that ends 67 can be close to second side walls 37 and such that each shaft portion 62 of connection strip 28 can securely be coupled in an associated coupling slot 54. Therefore, connection strip 28 and installation strips 26 can withstand impact exerted on inner surfaces 20 or outer surfaces 22 of door panels 12.

Figure 7:
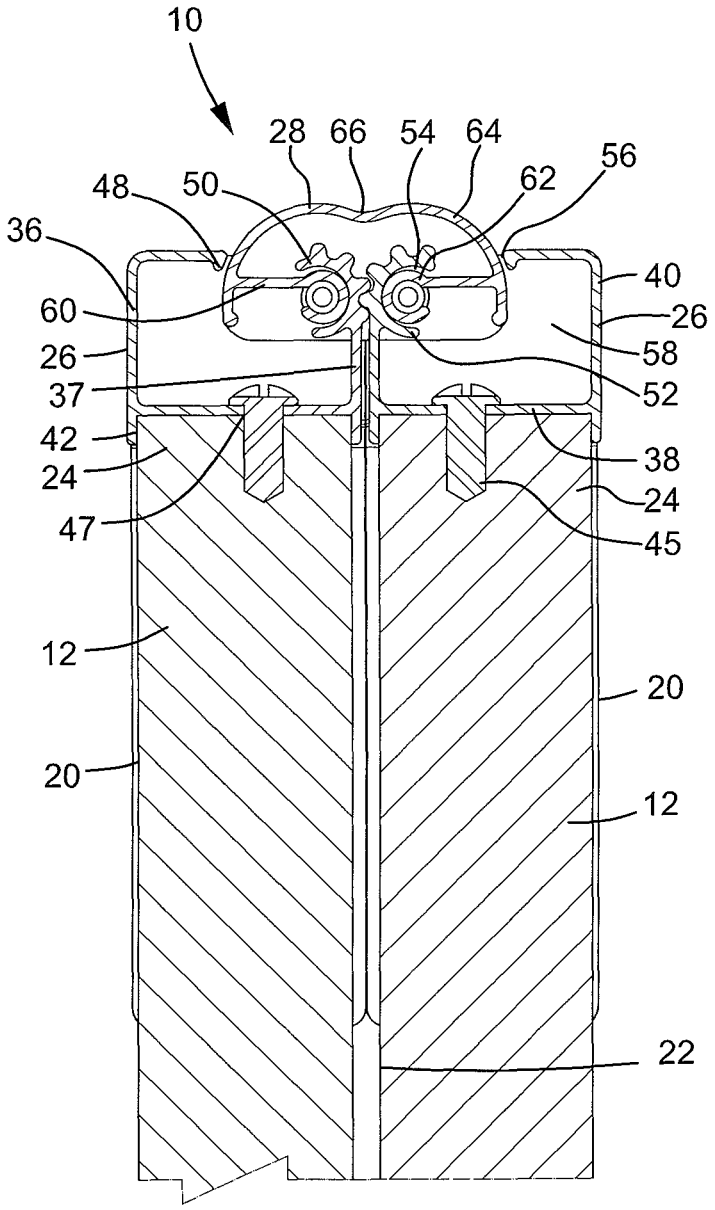
FIG. 7 shows a view similar to FIG. 5, with the door panels folded from a closed state to an open state.

In an example of assembling hinge device 10, second side walls 37 of installation strips 26 abut with each other, with toothed portions 50 meshed with each other (see FIG. 7). Then, connection strip 28 is inserted through openings 56 into installation strips 26 in the longitudinal direction, with each shaft portion 62 of connection strip 28 received in coupling slot 54 of an associated installation strip 26. Thus, installation strips 26 (including upper and lower sections 30 and 32 and intermediate section 34) are connected by connection strip 28 and can pivot synchronously relative to the connection strip 28 between a first position and a second position, with shaft portions 62 serving as pivots. When installation strips 26 are in the first position (inner ends 40 located between outer ends 42, see FIG. 5), door panels 12 are unfolded and aligned end to end to form a rectilinear structure, folding door 14 is in a closed state, and connection strip 28 is covered by installation strips 26. On the other hand, when installation strips 26 are in the second position (see FIG. 7), door panels 12 are folded and abut with each other side by side, folding door 14 is in an open state, and cover portion 64 of connection strip 28 is located outside of installation strips 26. Preferably, the length of shield 52 of each installation strip 26 in the thickness direction extends beyond a center of an associated coupling slot 54, such that the center of coupling slot 54 of each installation strip 26 is located between a distal end of a corresponding shield 52 and second side wall 37 in the thickness direction (FIG. 7). Thus, in the open state shown in FIG. 7, when a longitudinal external force is applied to connection strip 28, shields 52 of installation strips 26 can effectively withstand the external force and can prevent shaft portions 62 from disengaging from coupling slots 54.

In use, when door panels 12 is in the closed state (FIG. 5), connection strip 28 is concealed in installation strips 26, and toothed portions 50 of installation strips 26 are located on a side of outer surfaces 22 of door panels 12. Thus, connection strip 28 can be protected effectively from damage, and toothed portions 50 can be prevented from being splashed by water. Furthermore, in the closed state, distal ends 48 of extensions 46 of installation strips 26 are received in recessed portion 66 of cover portion 64, and extensions 46 abut with each other, such that only a small gap or no gap exists between door panels 12 to enhance the privacy, and such that door panels 12 can securely be connected together.

Figure 5:
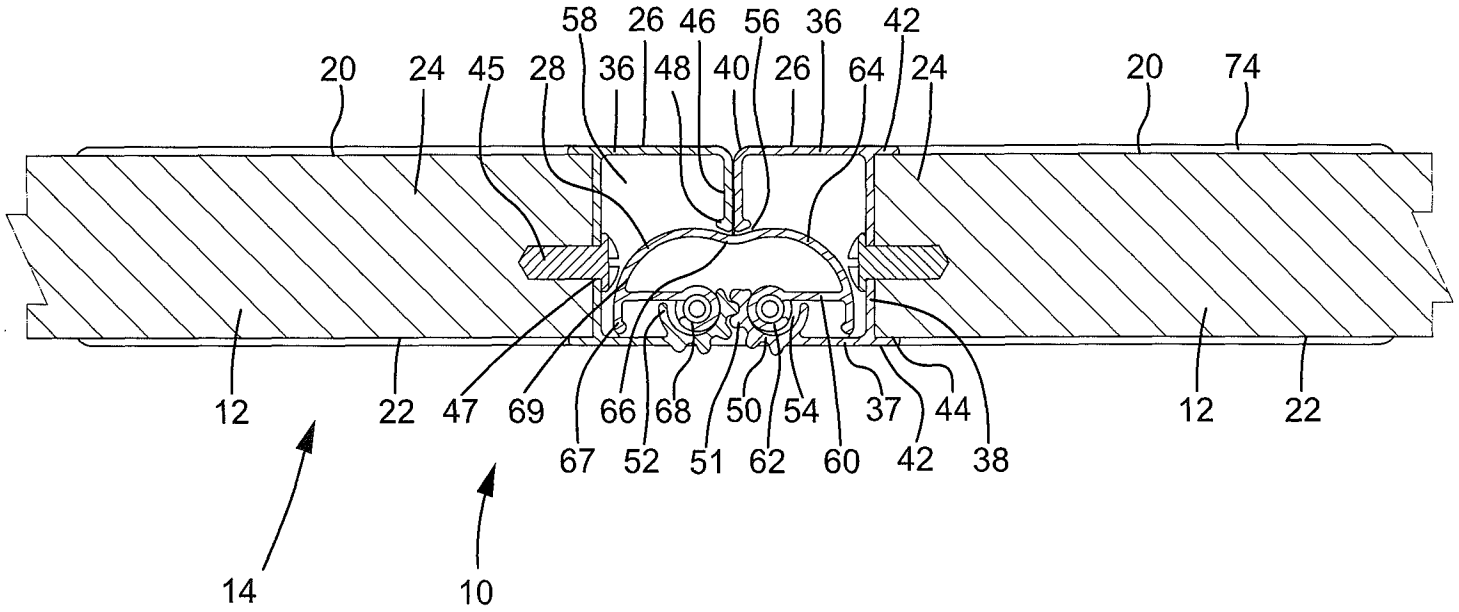
FIG. 5 is a cross sectional view taken along line 5-5 in FIG. 3.
Figure 6:
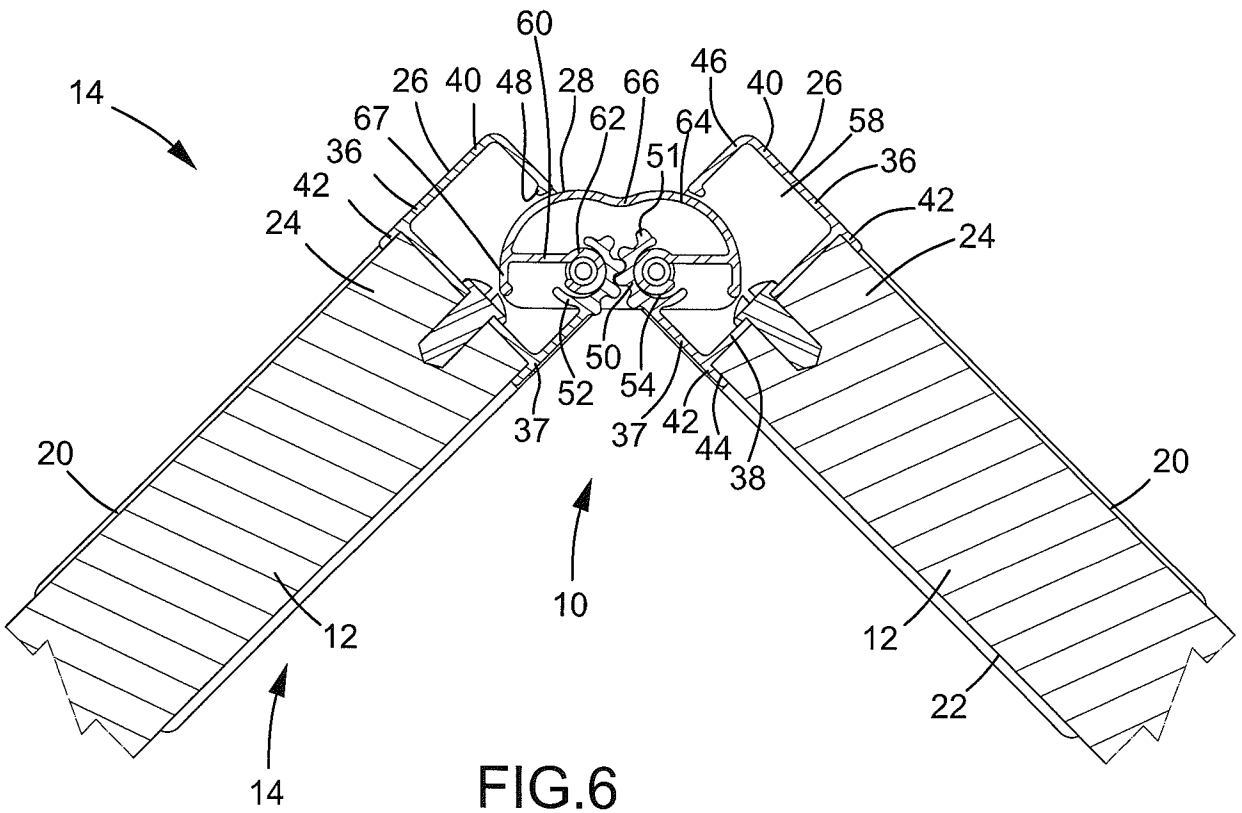
FIG. 6 shows a view similar to FIG. 5, with two installation strips of the hinge device pivoted relative to a connection strip of the hinge device.

In addition, when door panels 12 are in the open state shown in FIG. 7, distal end 48 of extension 46 of each installation strip 26 is located near or abuts an outer surface of cover portion 64, and toothed portions 50 of installation strips 26 reliably mesh with each other for maintaining connection of door panels 12. Furthermore, shaft portions 62 of connection strip 28 are securely coupled in coupling slots 54 to allow smooth pivotal movement of door panels 12. Referring to FIGS. 5 to 7, the center of coupling slot 54 of each installation strip 26 is not concentric to the center of an associated shaft portion 62, such that the contact surface between each installation strip 26 and the corresponding shaft portion 62 is the smallest regardless of the angle between door panels 12 when door panels 12 are pivoted, achieving the purposes of smooth pivotal movement.

Figure 8:
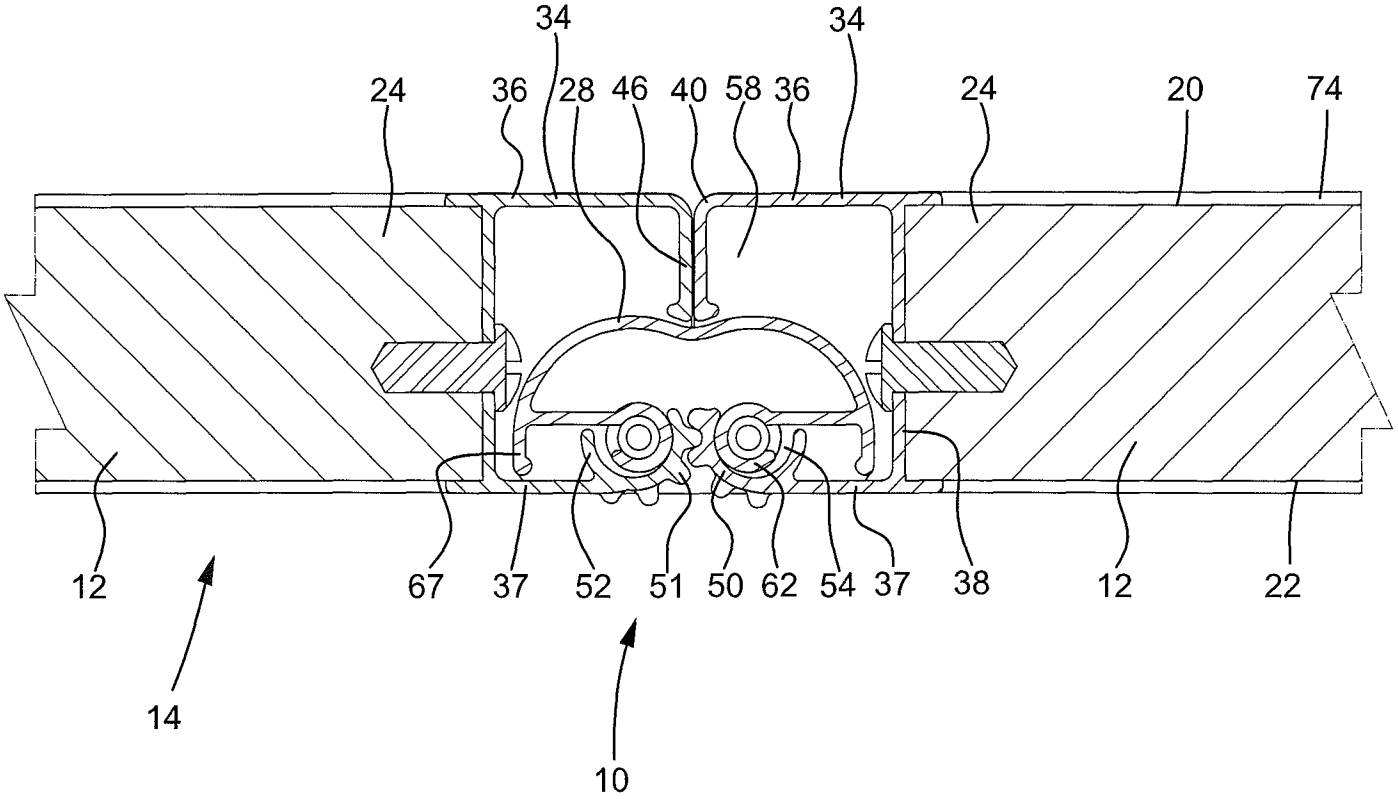
FIG. 8 is a cross sectional view taken along line 8-8 in FIG. 3.

Referring to FIG. 8, toothed portion 50 of intermediate section 34 of each installation strip 26 can include fewer teeth 51, such as one or two teeth 51. With this arrangement, when a user presses hinge device 10 by a hand to open or close door panels 12, the hand touching toothed portions 50 of intermediate sections 34 of installation strips 26 will not be pinched by teeth 51 of hinge device 10. At the same time, when door panels 12 are in the closed state, toothed portions 50 still mesh with teeth 51 to keep door panels 12 together.

Figure 1:
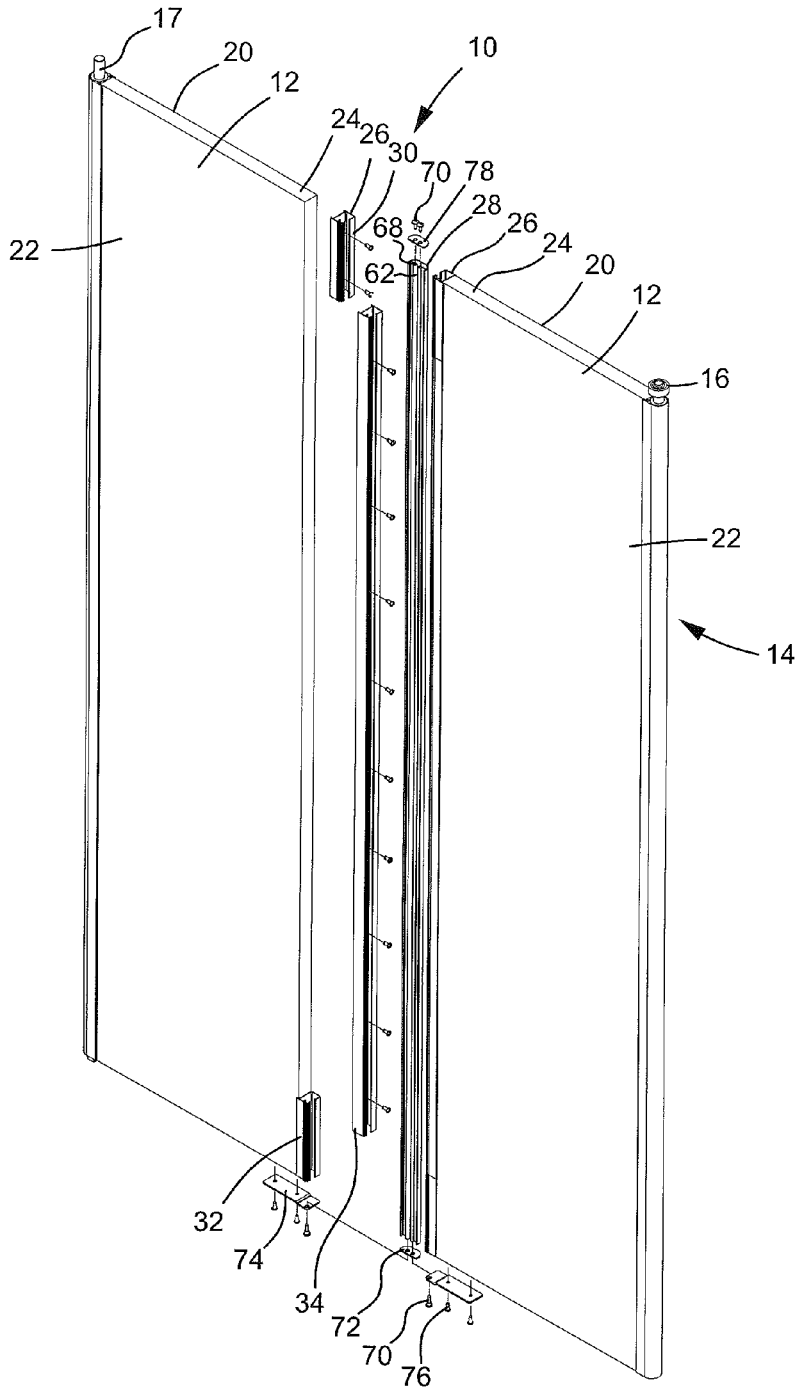
FIG. 1 shows an exploded, perspective view of a hinge device of a first embodiment according to the present invention, with two door panels connected by the hinge device to form a folding door.
Figure 2:
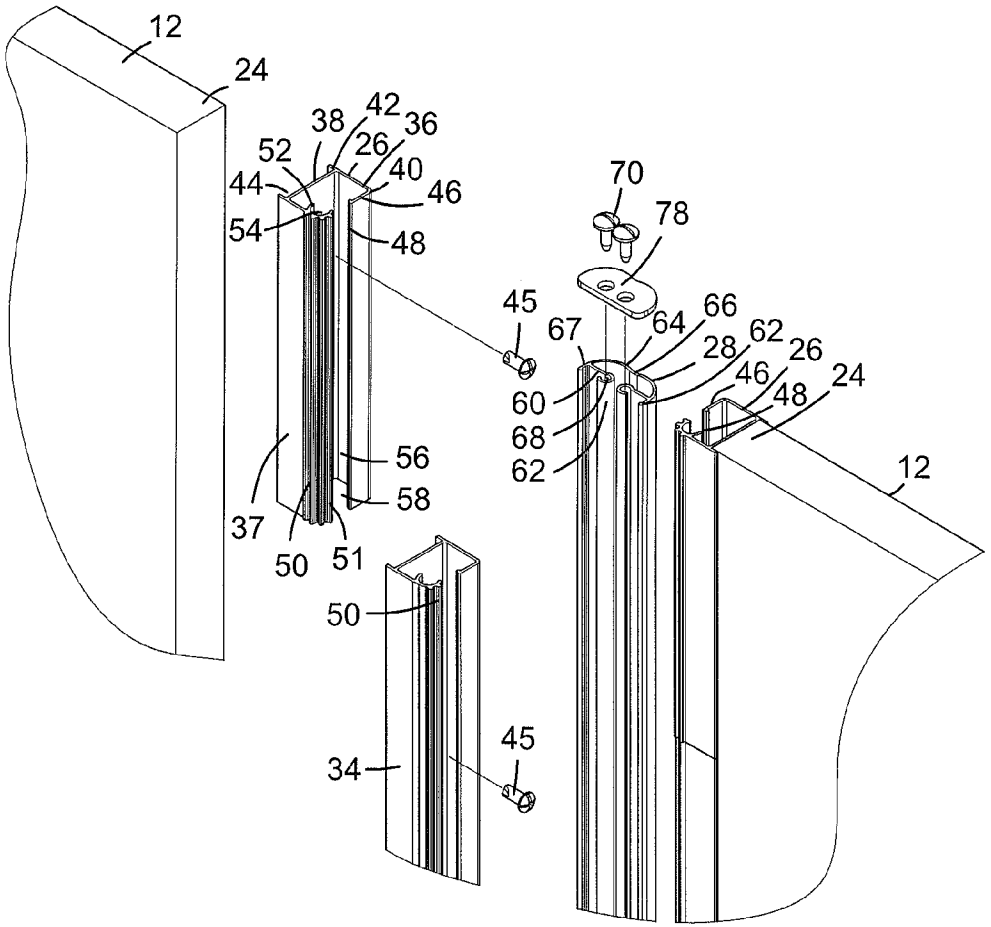
FIG. 2 is a partial, enlarged view of the folding door of FIG. 1.
Figure 9:
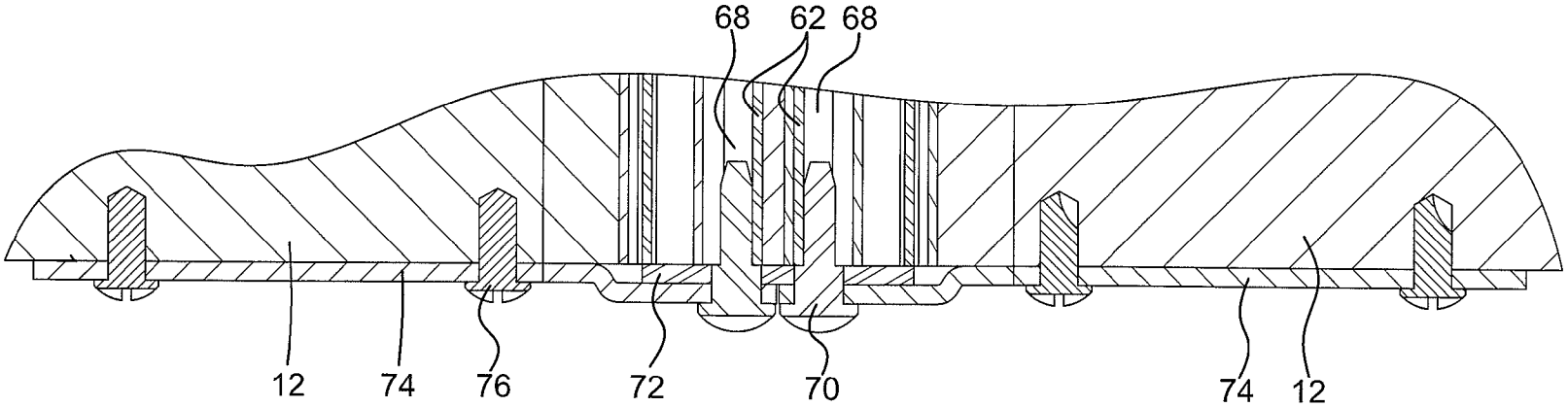
FIG. 9 shows a partial, sectional view of a bottom portion of the folding door of FIG. 1.

Referring to FIGS. 1 and 9, a through-hole 68 is provided in each shaft portion 62 for receiving a screw 70. Lower end faces of installation strips 26 engage with a common washer 72, and a lower end face of each door panel 12 engages with a connecting board 74 by screws 76. Each screw 70 extends through one of connecting boards 74 and washer 72 and extends into through-hole 68 in a lower end of a corresponding shaft portion 62 to position connection strip 28 in the longitudinal direction and to prevent connection strip 28 from moving relative to installation strips 26. Furthermore, upper end faces of installation strips 26 engage with a common washer 78. Washer 78 is fixed by screws 70 screwed into the upper ends of shaft portions 62 to prevent screws 70 from getting loose.

Figure 10:
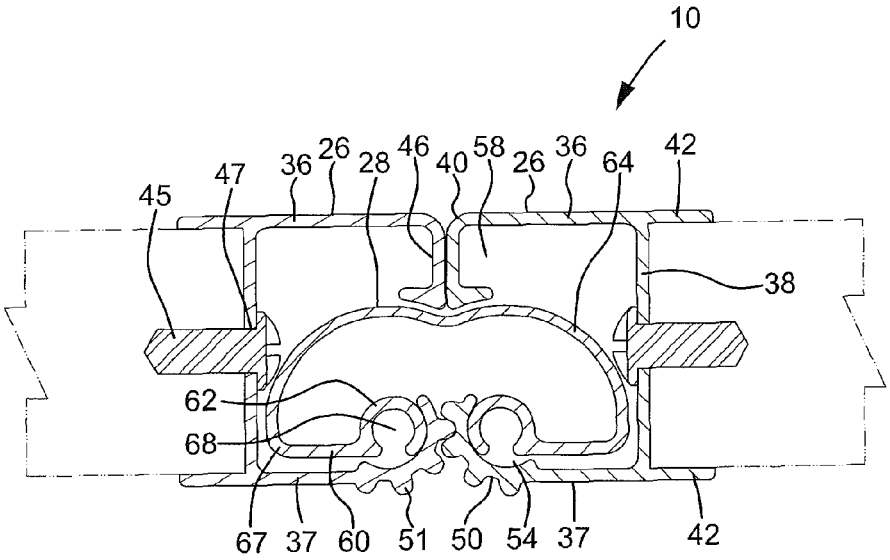
FIG. 10 is a schematic, cross sectional view of a hinge device of a second embodiment according to the present invention.
Figure 11:
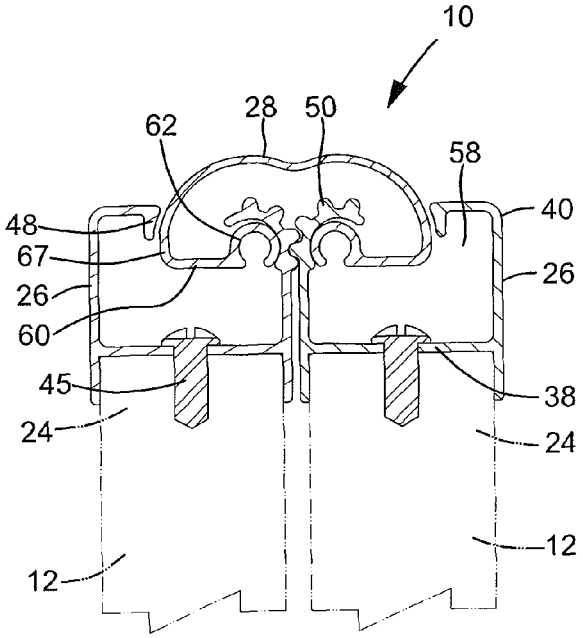
FIG. 11 shows a view similar to FIG. 10, with the door panels folded from a closed state to an open state.

FIGS. 10 and 11 show a hinge device 10 of a second embodiment according to the present invention modified from the first embodiment. In this embodiment, ends 67 of cover portion 64 do not protrude beyond shaft arms 60, and inner ends 40 of second side walls 37 of installation strips 26 do not include shields 52. Coupling slots 54 of installation strips 26 are formed only by the inner faces of toothed portions 50. Furthermore, cover portion 64 is spaced from shaft portions 62 of connection strip 28 by an appropriate spacing, and toothed portion 50 and extension 46 of each installation strip 26 are spaced from each other by an appropriate spacing, allowing screws 45 to pass through the spacings to fix installation strips 26 to door panels 12.

Figure 12:
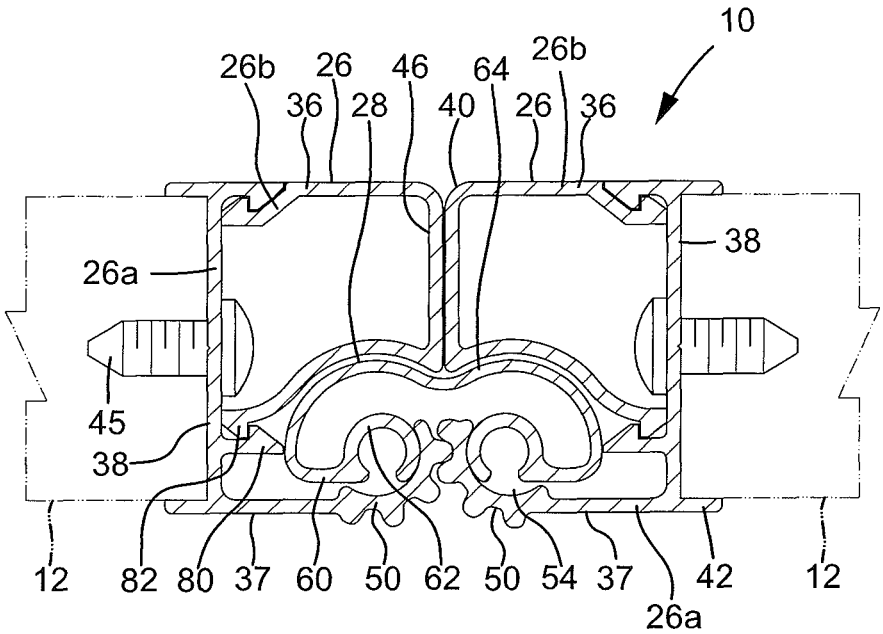
FIG. 12 is a schematic, cross sectional view of a hinge device of a third embodiment according to the present invention.
Figure 13:
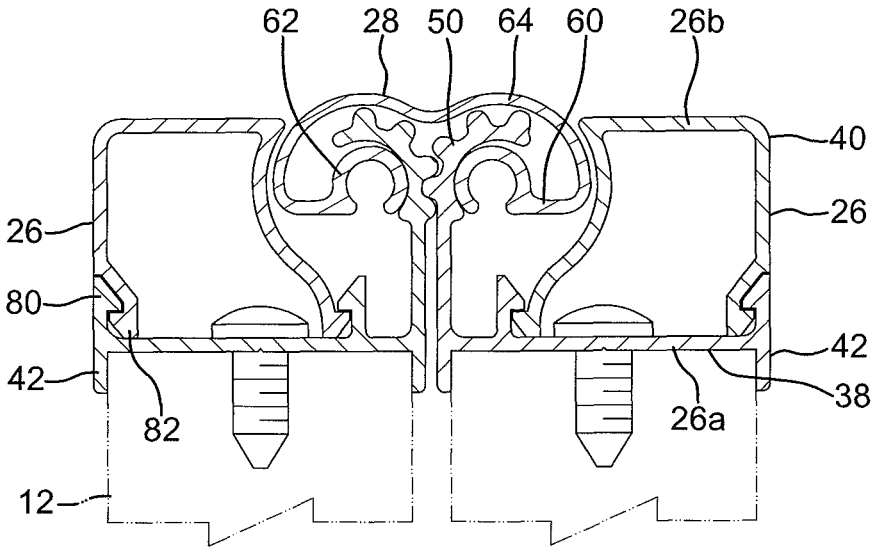
FIG. 13 shows a view similar to FIG. 12, with the door panels folded from a closed state to an open state.

FIGS. 12 and 13 show a hinge device 10 of a third embodiment according to the present invention modified from the second embodiment. In this embodiment, each installation strip 26 includes first and second installation strip members **26*a* and 26*b*. First installation strip member 26*a* includes second side wall 37 and connection wall 38, and second installation strip member 26*b* includes first side wall 36 and extension 46. After first installation strip member 26*a* is coupled to an associated door panel 26 by screws 45, second installation strip member 26*b* is coupled with first installation strip member 26*a*. With this provision, installation strips 26 can be assembled on door panels 12 more conveniently. In this embodiment, first installation strip member 26*a* is provided with two first hook portions 80, and second installation strip member 26*b* is provided with two second hook portions 82 respectively engaged with first hook portions 80 of first installation strip member 26*a***.

Figure 14:
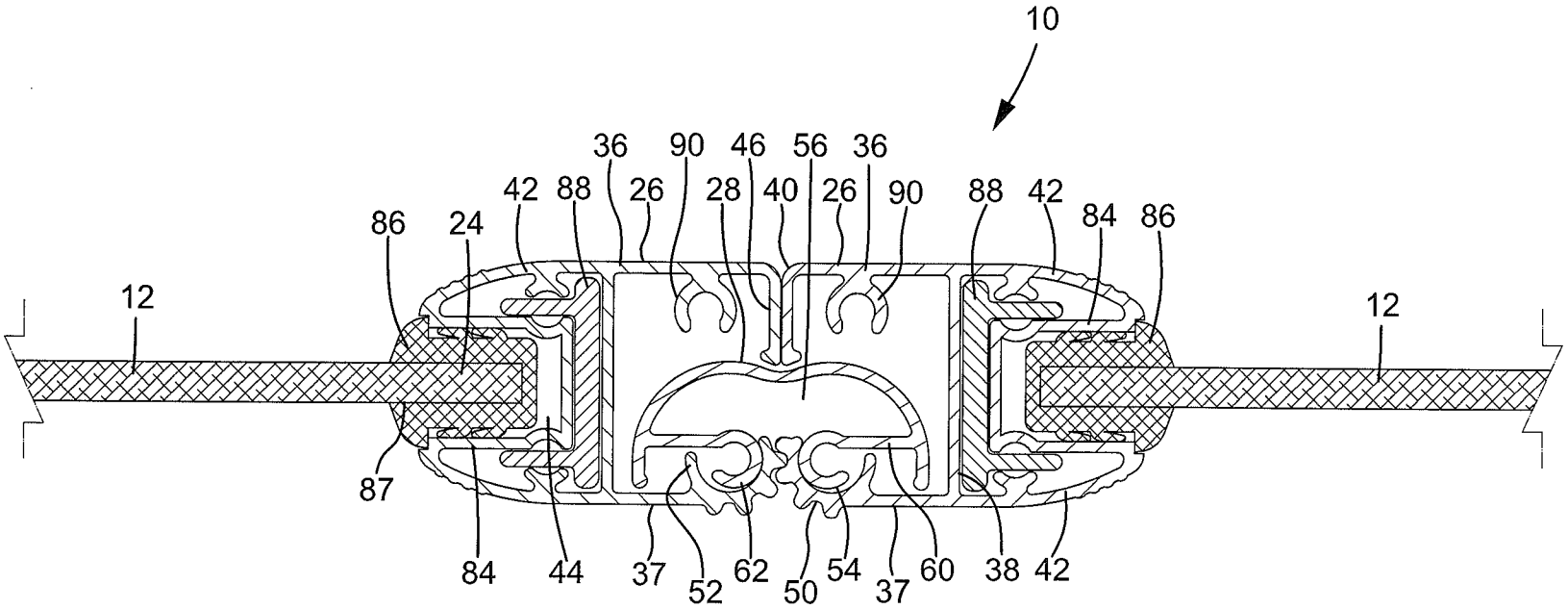
FIG. 14 is a schematic view of a hinge device of a fourth embodiment according to the present invention, with two thin door panels connected by the hinge device to form a folding door.

FIG. 14 shows a hinge device 10 of a fourth embodiment according to the present invention modified from the first embodiment. Hinge device 10 of this embodiment is adapted to be mounted to thin door panels 12. In this embodiment, outer ends 42 of first and second side walls 36 and 37 of each installation strip 26 protrude from connection wall 38 and away from inner end 40 in the width direction to form two extension ears 84, with each extension ear 84 being hollow. Installation slot 44 of each installation strip 26 is defined between extending ears 84. A coupling strip 86 made of soft material is mounted in each installation slot 44. Each coupling strip 86 includes a coupling slot 87 for receiving inner end 24 of an associated door panel 12, such that each installation strip 26 can be fixed to inner end 24 of the associated door panel 12. Furthermore, a substantially U-shaped frame strip 88 is mounted in extending ears 84 of each installation strip 26 for enhancing the engagement of upper and lower sections 30 and 32 and intermediate section 34 of each installation strip 26. Further, each installation strip 26 has a holder 90 for engaging with a top cover for covering an upper end of hinge device 10.

Although specific embodiments have been illustrated and described, numerous modifications and variations are still possible without departing from the essence of the invention. The scope of the invention is limited by the accompanying claims.

The invention claimed is:

1. A hinge device for a folding door, with the folding door including two door panels each having an inner end, with the hinge device adapted for connecting the inner ends of the two door panels to allow the two door panels to pivot synchronously upon movement of one of the two door panels, with the hinge device comprising:

two installation strips, with each of the two installation strips extending in a longitudinal direction and including a first side wall, a second side wall spaced from the first side wall in a thickness direction perpendicular to the longitudinal direction, and a connection wall connected between the first and second side walls, with each of the first and second side walls including inner and outer ends spaced from each other in a width direction perpendicular to the longitudinal and thickness directions, with the outer ends of the first and second side walls respectively protruding from the connection walls and away from the inner ends of the first and second side walls in the width direction, with an installation slot defined between the outer ends of the first and second side walls and adapted for receiving the inner end of an associated door panel, with each of the two installation strips further including a toothed portion extending from the inner end of the second side wall thereof toward but spaced from the first side wall thereof, with the toothed portions of the two installation strips meshed with each other; and a connection strip extending in the longitudinal direction and including a cover portion and two shaft arms located in the cover portion and spaced from each other, with each of the two shaft arms including an outer end connected to the cover portion, with each of the two shaft arms further including an inner end forming a shaft portion, with shaft portion of each of the two shaft arms engaged in the toothed portion of one of the two installation strips, with the two installation strips being pivotable relative to the connection strip between a first position and a second position, allowing the two door panels to pivot synchronously upon movement of one of the two door panels;

wherein when the two installation strips are in the first position, the door panels are unfolded, and the connection strip is located in the two installation strips, and wherein when the two installation strips are in the second position, the door panels are folded, and the cover portion of the connection strip is partially located outside of the two installation strips, with each of the two installation strips further including a shield extending from the inner end of the second side wall thereof toward but spaced from the connection wall thereof, with a coupling slot defined by the shield and an inner face of an associated toothed portion and being substantially semi-circular in cross section, with each shaft portion of the connection strip engaged in the coupling slot of one of the two installation strips, and with the coupling slot of each of the two installation strips having a center located between a distal end of the shield and the second side wall of the installation strip.

2. The hinge device according to claim 1, with each of the two installation strips including an upper section, a lower section, and an intermediate section between the upper and lower sections, with the toothed portion of each of the two installation strips including a plurality of teeth formed on an outer face thereof, with a number of the plurality of teeth of the toothed portion at the intermediate section of each of the two installation strips being less than a number of the plurality of teeth of the toothed portion at each of the upper and lower sections.

3. The hinge device according to claim 1, with each of the two installation strips including first and second installation strip members, with the first installation strip member including the second side wall and the connection wall, with the second installation strip member including the first side wall, with the first installation strip member including two first hook portions, with the second installation strip member including two second hook portions respectively engaged with the first hook portions of the first installation strip member.

4. The hinge device according to claim 1, with the outer ends of the first and second side walls of each of the two installation strips respectively protruding from the connection walls and away from the inner ends of the first and second side walls to form two extension ears, with the installation slot of each of the two installation strips defined between the two extending ears, with a coupling strip mounted in the installation slot and including a coupling slot, with the coupling slot adapted to receive the inner end of an associated door panel.

5. The hinge device according to claim 1, with the connection wall of each of the two installation strips including a hole, with a screw adapted to extend through the hole to fix each of the two installation strips to the inner end of an associated door panel.

6. A hinge device for a folding door, with the folding door including two door panels each having an inner end, with the hinge device adapted for connecting the inner ends of the two door panels to allow the two door panels to pivot synchronously upon movement of one of the two door panels, with the hinge device comprising:

two installation strips, with each of the two installation strips extending in a longitudinal direction and including a first side wall, a second side wall spaced from the first side wall in a thickness direction perpendicular to the longitudinal direction, and a connection wall connected between the first and second side walls, with each of the first and second side walls including inner and outer ends spaced from each other in a width direction perpendicular to the longitudinal and thickness directions, with the outer ends of the first and second side walls respectively protruding from the connection walls and away from the inner ends of the first and second side walls in the width direction, with an installation slot defined between the outer ends of the first and second side walls and adapted for receiving the inner end of an associated door panel, with each of the two installation strips further including a toothed portion extending from the inner end of the second side wall thereof toward but spaced from the first side wall thereof, with the toothed portions of the two installation strips meshed with each other; and a connection strip extending in the longitudinal direction and including a cover portion and two shaft arms located in the cover portion and spaced from each other, with each of the two shaft arms including an outer end connected to the cover portion, with each of the two shaft arms further including an inner end forming a shaft portion, with shaft portion of each of the two shaft arms engaged in the toothed portion of one of the two installation strips, with the two installation strips being pivotable relative to the connection strip between a first position and a second position, allowing the two door panels to pivot synchronously upon movement of one of the two door panels, wherein when the two installation strips are in the first position, the door panels are unfolded, and the connection strip is located in the two installation strips, wherein when the two installation strips are in the second position, the door panels are folded, and the cover portion of the connection strip is partially located outside of the two installation strips, with each of the two installation strips further including an extension extending from the inner end of the first side wall thereof toward but spaced from the second side wall thereof, with the extension of each of the two installation strips including a distal end, and with the toothed portion and the distal end of the extension of each of the two installation strips spaced from each other and defining an opening therebetween, wherein when the two installation strips are in the first position, the extensions of the two installation strips abut with each other, and the distal ends of the extensions are located at a middle of the cover portion of the connection strip, and wherein when the two installation strips are in the second position, the cover portion of the connection strip is located between the distal ends of the extensions of the two installation strips.

7. The hinge device according to claim 6, with each of the two installation strips further including a shield extending from the inner end of the second side wall thereof toward but spaced from the connection wall thereof, with a coupling slot defined by the shield and an inner face of an associated toothed portion and being substantially semi-circular in cross section, with each of the shaft portions of the connection strip engaged in the coupling slot of one of the two installation strips.

8. The hinge device according to claim 6, with each of the two installation strips including first and second installation strip members, with the first installation strip member including the second side wall and the connection wall, with the second installation strip member including the first side wall, with the first installation strip member including two first hook portions, with the second installation strip member including two second hook portions respectively engaged with the first hook portions of the first installation strip member.

9. The hinge device according to claim 6, with the outer ends of the first and second side walls of each of the two installation strips respectively protruding from the connection walls and away from the inner ends of the first and second side walls to form two extension ears, with the installation slot of each of the two installation strips defined between the two extending ears, with a coupling strip mounted in the installation slot and including a coupling slot, with the coupling slot adapted to receive the inner end of an associated door panel.

10. The hinge device according to claim 6, with the connection wall of each of the two installation strips including a hole, with a screw adapted to extend through the hole to fix each of the two installation strips to the inner end of an associated door panel.

11. The hinge device according to claim 6, with each of the two installation strips including an upper section, a lower section, and an intermediate section between the upper and lower sections, with the toothed portion of each of the two installation strips including a plurality of teeth formed on an outer face thereof, with a number of the plurality of teeth of the toothed portion at the intermediate section of each of the two installation strips being less than a number of the plurality of teeth of the toothed portion at each of the upper and lower sections.

12. A hinge device for a folding door, with the folding door including two door panels each having an inner end, with the hinge device adapted for connecting the inner ends of the two door panels to allow the two door panels to pivot synchronously upon movement of one of the two door panels, with the hinge device comprising:

two installation strips, with each of the two installation strips extending in a longitudinal direction and including a first side wall, a second side wall spaced from the first side wall in a thickness direction perpendicular to the longitudinal direction, and a connection wall connected between the first and second side walls, with each of the first and second side walls including inner and outer ends spaced from each other in a width direction perpendicular to the longitudinal and thickness directions, with the outer ends of the first and second side walls respectively protruding from the connection walls and away from the inner ends of the first and second side walls in the width direction, with an installation slot defined between the outer ends of the first and second side walls and adapted for receiving the inner end of an associated door panel, with each of the two installation strips further including a toothed portion extending from the inner end of the second side wall thereof toward but spaced from the first side wall thereof, with the toothed portions of the two installation strips meshed with each other; and a connection strip extending in the longitudinal direction and including a cover portion and two shaft arms located in the cover portion and spaced from each other, with each of the two shaft arms including an outer end connected to the cover portion, with each of the two shaft arms further including an inner end forming a shaft portion, with shaft portion of each of the two shaft arms engaged in the toothed portion of one of the two installation strips, with the two installation strips being pivotable relative to the connection strip between a first position and a second position, allowing the two door panels to pivot synchronously upon movement of one of the two door panels, wherein when the two installation strips are in the first position, the door panels are unfolded, and the connection strip is located in the two installation strips, wherein when the two installation strips are in the second position, the door panels are folded, and the cover portion of the connection strip is partially located outside of the two installation strips, with each of the two installation strips further including a shield extending from the inner end of the second side wall thereof toward but spaced from the connection wall thereof, with a coupling slot defined by the shield and an inner face of an associated toothed portion and being substantially semi-circular in cross section, with each shaft portion of the connection strip engaged in the coupling slot of one of the two installation strips, with a spacing between centers of the shaft portions of the connection strip being slightly smaller than a spacing between centers of the toothed portions of the two installation strips, and with each shaft portion having an outer diameter smaller than an inner diameter of the coupling slot of an associated one of the two installation strips.

13. The hinge device according to claim 12, with each of the two installation strips further including an extension extending from the inner end of the first side wall thereof toward but spaced from the second side wall thereof, with the extension of each of the two installation strips including a distal end, with the toothed portion and the distal end of the extension of each of the two installation strips spaced from each other and defining an opening therebetween, with the cover portion including two arc-shaped sections, with each of the two arc-shaped sections connected to the outer end of a corresponding shaft arm and having a center located in one of the shaft portions or one of the coupling slots, and with the two arc-shaped sections connected with each other to form a recessed portion, wherein when the two installation strips are in the first position, the distal ends of the extensions of the two installation strips are received in the recessed portion of the cover portion of the connection strip, and with the cover portion having substantially C-shaped cross sections, with the cover portion including two ends protruding beyond the two shaft arms, with each of the two ends of the cover portion having a distal end, with the two shaft arms located between the two ends of the cover portion, with centers of the shaft portions located intermediate the two shaft arms and the distal ends of the two ends of the cover portion in a direction perpendicular to the two shaft arms, with a length of each of the two ends of the cover portion beyond an associated one of the two shaft arms corresponding to the shield of an associated installation strip when the two installation strips are in the second position in which the two door panels are folded.

14. The hinge device according to claim 12, with the coupling slot of each of the two installation strips having a center located between a distal end of the shield and the second side wall of the installation strip.

15. The hinge device according to claim 12, with each of the two installation strips including an upper section, a lower section, and an intermediate section between the upper and lower sections, with the toothed portion of each of the two installation strips including a plurality of teeth formed on an outer face thereof, with a number of the plurality of teeth of the toothed portion at the intermediate section of each of the two installation strips being less than a number of the plurality of teeth of the toothed portion at each of the upper and lower sections.

16. The hinge device according to claim 12, with each of the two installation strips including first and second installation strip members, with the first installation strip member including the second side wall and the connection wall, with the second installation strip member including the first side wall, with the first installation strip member including two first hook portions, with the second installation strip member including two second hook portions respectively engaged with the first hook portions of the first installation strip member.

17. The hinge device according to claim 12, with the outer ends of the first and second side walls of each of the two installation strips respectively protruding from the connection walls and away from the inner ends of the first and second side walls to form two extension ears, with the installation slot of each of the two installation strips defined between the two extending ears, with a coupling strip mounted in the installation slot and including a coupling slot, with the coupling slot adapted to receive the inner end of an associated door panel.

18. The hinge device according to claim 12, with the connection wall of each of the two installation strips including a hole, with a screw adapted to extend through the hole to fix each of the two installation strips to the inner end of an associated door panel.

* * * * *